United States Patent [19]

Itoh et al.

[11] Patent Number: 4,635,615

[45] Date of Patent: Jan. 13, 1987

[54] DEVICE FOR MOUNTING COOKING APPARATUS

[75] Inventors: Fumihiko Itoh, Shiga; Tatumi Usagawa; Ryo Sakai, both of Ohtsu; Yasakao Yamamoto, Shiga, all of Japan

[73] Assignee: Sanyo Electric, Osaka, Japan

[21] Appl. No.: 795,189

[22] Filed: Nov. 5, 1985

[30] Foreign Application Priority Data

Apr. 3, 1985 [JP] Japan ..... 60-70342

[51] Int. Cl.[4] ..... A21B 1/00; A47B 67/02

[52] U.S. Cl. ..... 126/273 A; 126/37 B; 126/19 M; 126/21 A; 126/275 R; 126/275 E; 108/42; 108/59; 219/386; 248/282; 312/245; 312/248

[58] Field of Search ..... 126/37 B, 37 R, 39 B, 126/19 M, 21 A, 273 A, 275 E, 275 R; 219/392, 385, 386, 10.55 R; 248/282; 312/248, 245, 246; 108/6, 42, 48, 64, 59

[56] References Cited

U.S. PATENT DOCUMENTS

| | | | |
|---|---|---|---|
| 2,095,227 | 10/1937 | Brown | 312/245 |
| 2,551,305 | 5/1951 | Tompkins | 312/248 X |
| 3,464,749 | 9/1969 | Bishop | 312/248 |

*Primary Examiner*—Randall L. Green

*Attorney, Agent, or Firm*—Handal & Morofsky

[57] ABSTRACT

The device for mounting a cooking apparatus of the present invention on a wall and the like in a kitchen comprises a wall fixing member to be fixedly mounted on the wall and provided with reinforcing members projecting forward; a supporting member rotatable up-and downwardly and provided with grooves in which the legs of the cooking apparatus are to be put; and a stopper member for preventing the legs of the cooking apparatus from coming off the grooves of the supporting member in case that the cooking apparatus is supported by said supporting member. Accordingly, the cooking apparatus can be easily mounted on the wall and the like in the kitchen without any extra members to be mounted on the cooking apparatus, so that a cooking apparatus of such a type originally used by being placed on a cooking counter and the like can be easily mounted on a wall in a kitchen.

9 Claims, 9 Drawing Figures

DEVICE FOR MOUNTING COOKING APPARATUS

BACKGROUND OF THE INVENTION

1. Field of the Invention

The present invention relates to a device for mounting a cooking apparatus such as a microwave oven on a wall and the like in the kitchen.

2. Description of the Prior Art

In order to effectively utilize an open space above a cooking counter by mounting a cooking apparatus which is usually used by being placed on the cooking counter and the like incorporated into a systematized kitchen, such as a microwave oven in the open space above the cooking counter, various kinds of device for mounting a cooking apparatus have been proposed. One of them is a device disclosed in Japanese Utility Model Application Laid-Open No. 59-155411. In this device, metallic fitting members are fixedly mounted on the upper portion of a body of a cooking apparatus, locking metallic fixtures for detachably mounting said metallic fitting members being fixedly mounted on a bottom plate of a wall cabinet, and said metallic fitting members being suspended on said locking metallic fixtures whereby mounting the cooking apparatus in a useless space above a cooking cabinet.

However, in this device, since said metallic fitting members are fixedly mounted on the upper portion of the body of cooking apparatus, said metallic fitting members are positioned at such a height that they tend to be touched by human hands and clothes when such a cooking apparatus is placed on said cooking counter corresponding to necessities in the same manner as in the conventional one. On this account, such situations that persons are injured by metallic fitting members fixedly mounted on the upper portion of the body of cooking apparatus and clothes are caught on them to be damaged have occurred. Also, since metallic fitting members are exposed, this device is not preferable in respect of external appearance.

OBJECT OF THE INVENTION

The present invention was achieved in view of the above described matters.

It is a first object of the present invention to provide a device for mounting a cooking apparatus on a wall and the like in a kitchen by a simple construction.

It is a second object of the present invention to provide a device for mounting a cooking apparatus on a wall and the like in a kitchen without requiring to fixedly mount any extra metallic members on a cooking apparatus body.

It is a third object of the present invention to provide a device for mounting a cooking apparatus capable of surely mounting a cooking apparatus on a wall in a kitchen.

It is a fourth object of the present invention to provide a device for mounting a cooking apparatus having no possibility that persons are injured, person's clothes being damaged, and an external appearance being spoiled when a cooking apparatus is used by being placed on a cooking counter and the like by adopting the construction that members for mounting are not fixedly mounted on the cooking apparatus.

It is a fifth object of the present invention to provide a device for mounting cooking apparatus capable of mounting a cooking apparatus on a wall without any possibility of the fall of the cooking apparatus when used and the like.

The above and further objects and features of the invention will more fully be apparent from the following detailed description with reference to accompanying drawings.

DETAILED DESCRIPTION OF THE INVENTION

Figure 1:
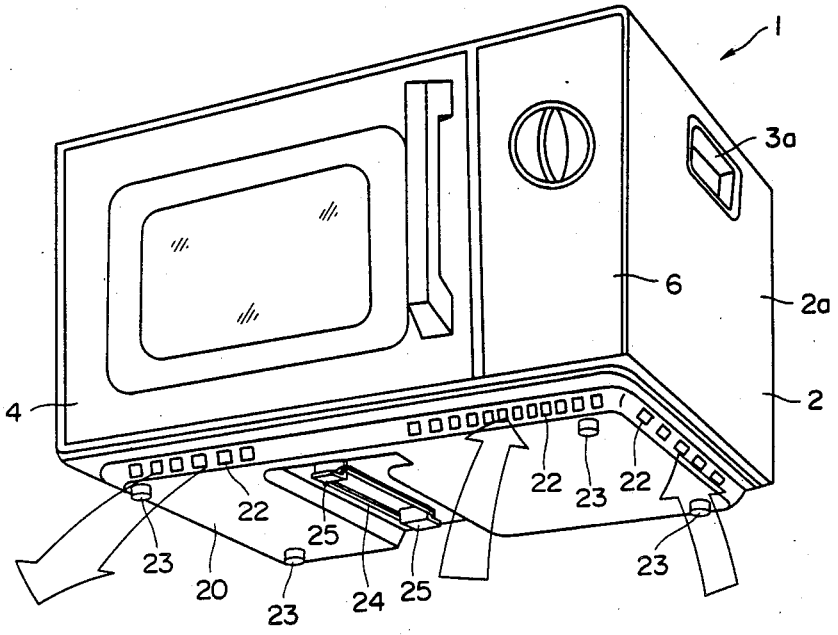
FIG. 1 is a schematic view showing a microwave oven as one example of a cooking apparatus viewed from the right-hand front lower side.
Figure 2:
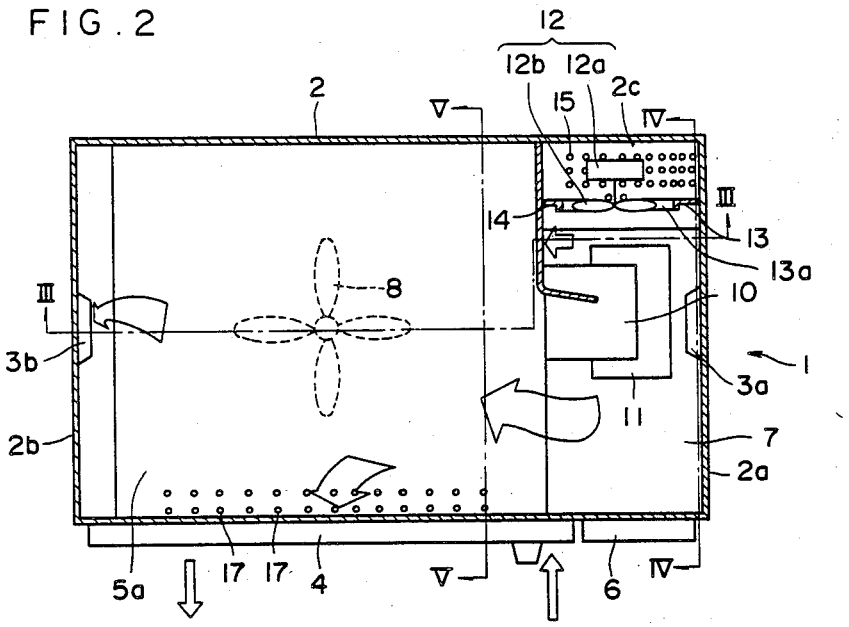
FIG. 2 is a horizontal sectional view showing a microwave oven.
Figure 3:
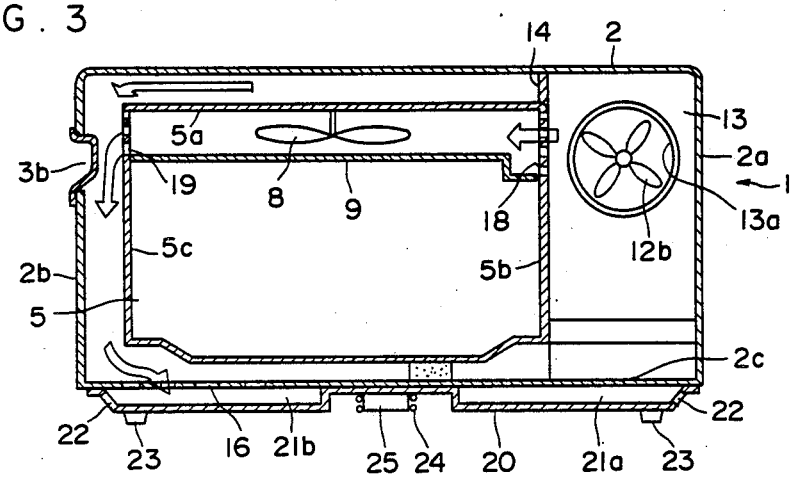
FIG. 3 is a vertical sectional view of FIG. 2 taken through the line III—III thereof.
Figure 4:
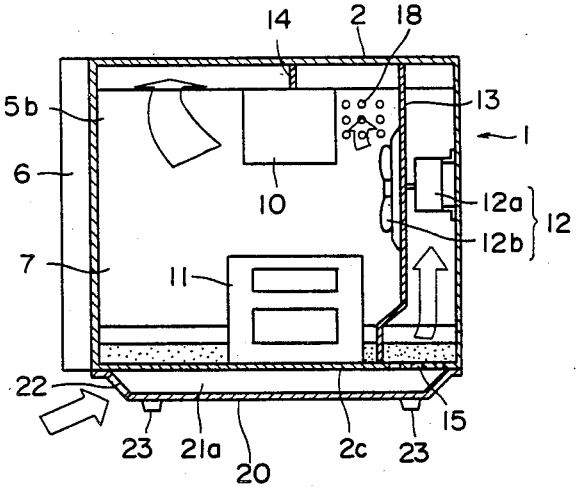
FIG. 4 is a vertical sectional view of FIG. 2 taken through the line IV—IV thereof.
Figure 5:
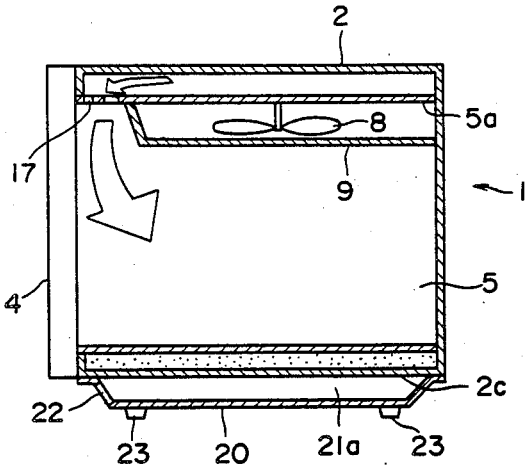
FIG. 5 is a vertical sectional view of FIG. 2 taken through the line V—V thereof.
Figure 6:
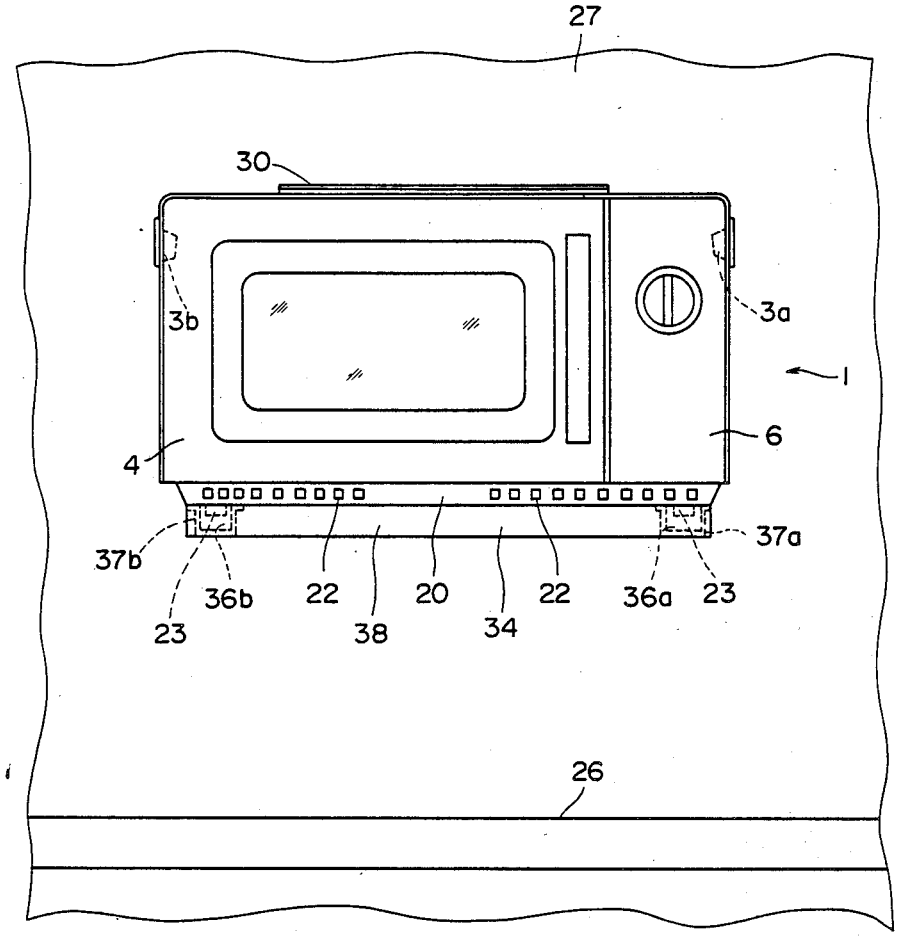
FIG. 6 is a schematic view showing the state where a microwave oven is mounted on a wall in a kitchen by means of a device of the present invention viewed from the front.

The present invention will be below described with reference to the drawings of the embodiments thereof.

FIGS. 1 to 5 show a microwave oven as a cooking apparatus to be mounted under a bottom plate and the like of a wall cabinet in a kitchen by means of a device of the present invention. A microwave oven body 1 is provided with handles 3*a*, 3*b* for carrying it on both right and left side walls 2*a*, 2*b* constructing the outer casing 2 thereof. The body 1 is provided with a microwave heating chamber 5, whose front opening is opened and closed by a door 4 and an electric apparatus chamber 7 positioned behind a control panel 6 for setting a cooking time, cooking temperature and the like therein.

The microwave heating chamber 5 is provided with a stirrer 8 for stirring microwaves and a stirrer cover 9 for covering the stirrer 8 arranged therein. The electric apparatus chamber 7 comprises a magnetron 10 for generating microwave for heating foodstuffs to the heating chamber 5, a high-voltage transformer 11 for applying a high voltage to the magnetron 10, a cooling device 12 comprising a motor 12*a* and a fan 12*b* for cooling the magnetron 10, the high-voltage transformer 11 and the like arranged therein. In addition, the electric apparatus chamber 7 is provided with a vertical partition wall 13 at the rear portion thereof and a L-shaped partition wall 14 above the heating chamber 5 of the rear side portion thereof. The vertical partition wall 13 is provided with an opening 13*a* in the upper portion thereof, the fan 12*b* of the cooling device 12 being positioned within the opening 13*a*.

Upon driving the cooling device 12, an air is sucked as a cooling air into the rear portion of the vertical partition wall 13 provided in the electric apparatus chamber 7 through a large number of suction holes 15 formed in the rear portion of an outer bottom wall 2c on the electric apparatus chamber 7 side and then discharged forward the electric apparatus chamber 7 through the opening 13a of the vertical partition wall 13 to cool the magnetron 10, the high-voltage transformer 11 and the like. Then a part of the air is flown through a portion where the L-shaped partition wall 14 does not exist, the upper portion outside the heating chamber 5, the left side of the heating chamber 5 downwardly and a large number of discharge holes 16 formed on the left side of the outer bottom wall 2c through which the air is discharged outside.

Also, part of the air flown up to the upper portion of the heating chamber 5 is flown along the inside surface of the door 4 to the lower portion inside the heating chamber 5 through a small hole 17 formed in the front portion of the upper wall 5a of the heating chamber 5. Then, in order to carry out the ventilation of the inside of the heating chamber, this air is flown through a passage (not shown) along with water vapour and the like generated from foodstuffs when heated by microwaves to reach the left side of the heating chamber 5 where it joins the air coming from the upper portion outside the heating chamber 5.

On the other hand, the rest of the air discharged forward the electric apparatus chamber 7 is flown up to the upper portion inside the heating chamber 5, through a small hole 18 formed on the right-hand wall 5b of the heating chamber 5 below the L-shaped partition wall 14, where it rotates the stirrer 8. Then this air is flown through a small hole 19 formed in the left-hand wall 5c of the heating chamber 5 to arrive at the left side of the heating chamber 5 and also joins the air coming from the upper portion of the heating chamber 5.

The microwave oven body 1 is provided with also a synthetic resin structure 20 fixedly mounted on the lower portion thereof. The structure 20 is provided with a right-hand projecting portion 21a and a left-hand projecting portion 21b, which project downward, on the right side and left side thereof respectively, the both projecting portions 21a, 21b being provided with an air hole 22 on the front portion and side portion thereof respectively. The right-hand projecting portion 21a communicates with the rear portion inside the electric apparatus chamber 7 through the suction hole 15 of the outer bottom wall 2c. Accordingly, an air is sucked into the rear portion inside the electric apparatus chamber 7 through the right projecting portion 21a from the lower front side and the right side of the microwave oven body 1. Also, the left projecting portion 21b communicates with the left side of the heating chamber 5 inside the outer casing 2 through the discharge hole 16 of the outer bottom wall 2c. Accordingly, an air coming to the left side of the heating chamber 5 is discharged toward the lower front side and the left side of the microwave oven body 1 through the left projecting portion 21b. In addition, the structure 20 is provided with support legs 23, 23 . . . at four corners of the lower surface thereof fixedly mounted integrally thereon and holders 25, 25 for holding a power source cord 24 wound therearound integrally fixedly mounted on the lower surface between the right projecting portion 21a and the left projecting portion 21b.

A microwave oven constructed in the above described manner is usually used by being placed on a cooking counter and the like incorporated into a systematized kitchen, and can also be easily lifted up by means of both handles 3a, 3b to carry to other places if necessary.

Also, in order to effectively utilize a space above a cooking counter, a cooking apparatus as described above can be mounted on a wall in an open space such as the under portion of wall cabinet above the cooking counter. A device for mounting a cooking apparatus for its sake, that is to say a device according to the present invention will be below described.

Figure 7:
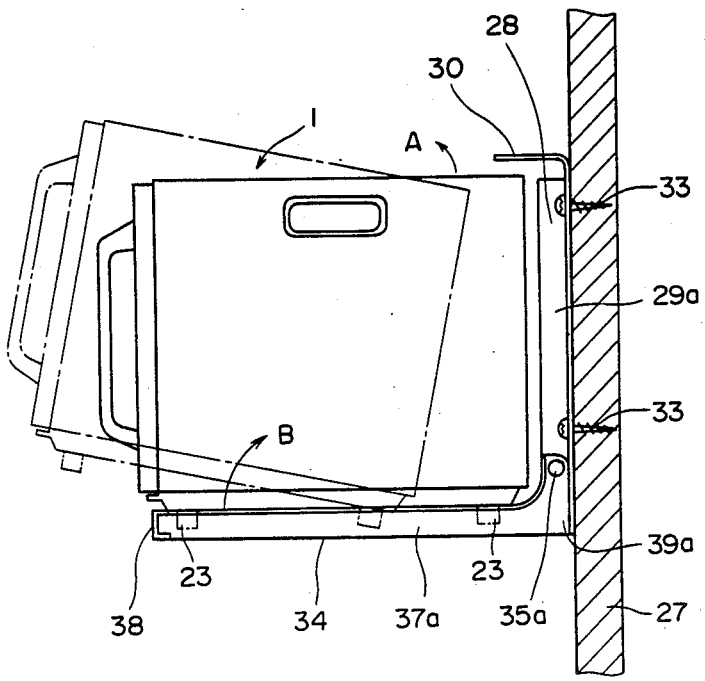
FIG. 7 is a schematic view showing the state where a microwave oven is mounted on a wall in a kitchen by means of a device of the present invention viewed from the right-hand side.
Figure 8:
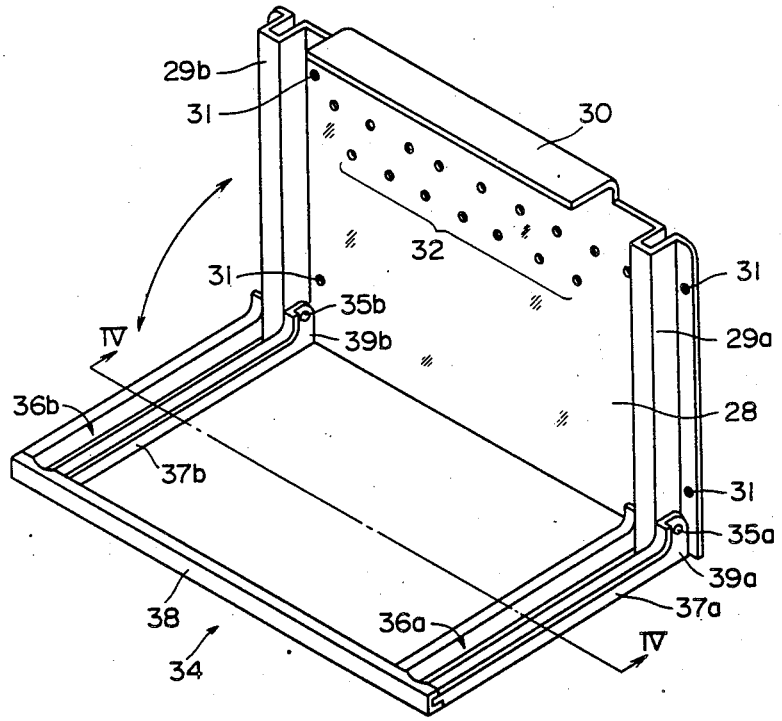
FIG. 8 is a schematic view showing a device of the present invention viewed from the right-hand front upper side.
Figure 9:
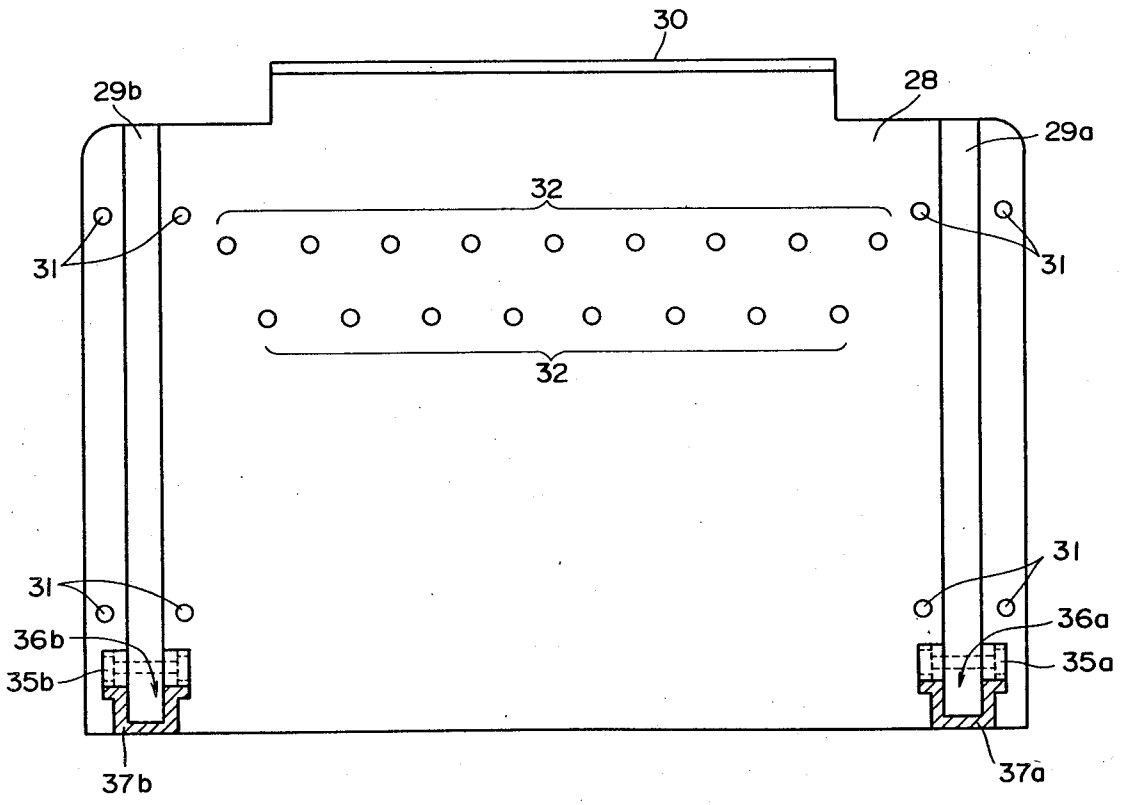
FIG. 9 is a front view showing a device of the present invention together with a sectional view of FIG. 8 taken through the line IX—IX thereof.

Referring now to FIGS. 6 to 9, wall fixing member 28 is fixedly mounted on a wall 27 above a cooking counter 26. This wall fixing member 28 is provided with reinforcing members 29a, 29b formed by pressing at the positions to both the left end and right end thereof and projecting forward along an up-and-down direction and a stopper member 30 for prohibiting a dangerous motion of a microwave oven formed by bending forward at the central portion of the upper end thereof, as described later. In addition, the wall fixing member 28 is provided with two threaded holes 31, 31 . . . formed on both sides of the reinforcing members 29a, 29b at four corners thereof respectively, and a large number of threaded holes 32, 32 . . . formed in two stages laterally at the position to the upper portion thereof. These threaded holes 31, 31 . . . and 32, 32 . . . are used for fixedly mounting the wall fixing member 28 and the wall 27 by means of screws but usually the threaded holes 31, 31 . . . formed at four corners of the wall fixing member 28 are used. However, if there are no suitable support members such as a pillar at the positions of the wall 27 corresponding to these threaded holes 31, 31 . . . , the threaded holes 32, 32 . . . formed laterally at the positions to the upper portion of the wall fixing member 28 are suitably selected to use. In this embodiment, as shown in FIG. 7, the wall fixing member 28 is fixedly mounted on the wall 27 by screws 33, 33 . . . in the threaded holes 31, 31 . . . formed at four corners thereof.

The wall fixing member 28 is provided with supporting member 34 for supporting a microwave oven mounted rotatably up-and downwardly by means of pins 35a, 35b at the position to the lower end thereof.

The supporting member 34 consists of arms 37a, 37b mounted rotatably up-and downwardly by means of pins 35a, 35b respectively, at the positions to the lower ends of the reinforcing members 29a, 29b of the wall fixing member 28 and a coupling member 38 for connecting both arms 37a, 37b at front ends thereof. Both arms 37a, 37b are provided with receiving portions 36a, 36b for receiving a supporting legs 23, 23 . . . of the microwave oven by forming the cross sections thereof in a U-shape. Also, the supporting member 34 is provided with base portions 39a, 39b of both arms 37a, 37b formed in such a shape that the rear end edge of the base portions 39a, 39b of both arms 37a, 37b are brought into contact with the surface of the wall fixing member 28 not to rotate downward any more under the condition that the longitudinal direction of the arms 37a, 37b meets at right angles with the surface of the wall fixing member 28, as shown concretely in FIGS. 7, 8. Accordingly, since usually the wall fixing member 28 is fixedly mounted on the vertical wall 27, the supporting member 34 is held horizontally.

A microwave oven is mounted on the wall 27 as follows by means of a device of the present invention consisting of the wall fixing member 28 and the supporting member 34 constructed in the above described manner:

At first, the microwave oven body 1 is lifted up and the rear left and right legs 23, 23 are put in the receiving portions 36*a,* 36*b* of the arms 37*a,* 37*b* respectively, as shown in FIG. 7 by an alternate long and short dash line. Then, the microwave oven body 1 is rearward slid on the arms 37*a,* 37*b* with gradually lowering the front portion thereof to finally put also the front left and right legs 23, 23 in the receiving portions 36*a,* 36*b* of the arms 37*a,* 37*b* whereby the microwave oven is mounted on the wall 27.

Under the condition that the microwave oven is mounted on the wall 27 in the above described manner, the forward movement of the microwave oven can be prevented by the engagement of the front left and right legs 23, 23 with the coupling member 38. Also, such an inclined state that the microwave oven is rotated in the direction of lifting up the rear portion around the front left and right legs 23, 23 thereof as the rotational center (the direction shown by an arrow A in FIG. 7), that is to say, the rear left and right legs 23, 23 are lifted up from the receiving portions 36*a,* 36*b* of the arms 37*a,* 37*b* can be prevented by the engagement of the upper rear portion of the microwave oven body 1 with the stopper member 30 positioned at the upper end of the wall fixing member 28. As described above, dangerous motions such as a forward movement and a rotation with lifting up the rear portion of the microwave oven round the front portion of the same can be prevented, so that the microwave oven can be stably supported on the supporting member 34. The above described rotation of the microwave oven body 1, wherein the rear portion thereof is lifted upwardly round the front portion thereof, occurs when a force pulling down, for example, the opened door 4 is applied.

In addition, under the above described condition of mounting the microwave oven on a device of the present invention, there is a gap having a size equal to at least a distance, by which the reinforcing members 29*a,* 29*b* are projected from the surface of the wall fixing member 28, between the rear surface of the microwave oven body 1 and the surface of the wall fixing member 28, so that a space for exhausting air can be sufficiently ensured even in the case that air is exhausted rearward from the microwave oven body 1.

The microwave oven mounted on the wall 27 in the above described manner can be easily removed from the wall 27 in a reversed way of operation described above and the removed microwave oven can be used by being placed on the cooking counter 26 and the like.

On the other hand, the wall fixing member 28 is always integrally connected with the supporting member 34 by means of the pins 35*a,* 35*b*. A device of the present invention can be folded up when carried. Accordingly, the volume occupied by the wall fixing member 28 and the supporting member 34 can be reduced, so that a device of the present invention is handy.

Furthermore, as easily understood from the above description, it is remarkably simple to fixedly mount a device of the present invention on the wall, since what is needed is to fixedly mount the wall fixing member 28 on the wall 27 by means of screws.

Also, even though the wall fixing member 28 is fixedly mounted on the wall 27, in the case that the microwave oven is not mounted, the supporting member 34 can be prevented from being unnecessarily projected from the wall 27 by rotating the supporting member 34 upward (in the direction shown by an arrow B in FIG. 7) to be folded up and fixing it by means of a stopper (not shown).

As described above, with a device for mounting a cooking apparatus of the present invention, a cooking apparatus can be mounted on a high place without requiring to fixedly mount any extra parts on a cooking apparatus body whereby in the case that the cooking apparatus is used by being placed on a cooking counter and the like if necessary, persons can be prevented from being injured and clothes can be prevented from being damaged by the cooking apparatus, the cooking apparatus being improved in external appearance, and thus, a device for mounting a cooking apparatus, which is simple in construction, easy to mount and handy, can be provided.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A device for mounting on a wall a cooking apparatus provided with legs on both the left side and the right side of a bottom surface thereof, comprising:

a wall fixing member to be fixedly mounted on the wall and provided with reinforcing members for improving the rigidity in the upward and downward direction;

a supporting member provided with receiving portions for receiving the legs of said cooking apparatus, supported on said reinforcing members of said wall fixing member being rotatable upwardly and downwardly, and supporting said cooking apparatus under the condition that said support member is positioned horizontally and the legs of said cooking apparatus are received in said receiving portions; and a stopper member positioned at an upper portion of said wall fixing member for preventing said cooking apparatus from coming off said receiving portions.

2. A device for mounting a cooking apparatus on a wall as set forth in claim 1, wherein said reinforcing members comprise a front projection respectively formed by bending with being forward projected on both the left side portion and the right side portion of said wall fixing member and extending up-and downwardly and said supporting member is provided with a pair of arms supported rotatably respectively on said front projection.

3. A device for mounting a cooking apparatus on a wall as set forth in claim 2, wherein said receiving portions are constructed of a pair of grooves formed on said pair of arms of said supporting member respectively.

4. A device for mounting a cooking apparatus on a wall as set forth in claim 2, wherein said supporting member is provided with a coupling member for connecting said pair of arms at the front ends thereof.

5. A device for mounting a cooking apparatus on a wall as set forth in claim 3, wherein said supporting member is provided with a coupling member for connecting said pair of arms at the front ends thereof.

6. A device for mounting a cooking apparatus on a wall as set forth in claim 5, wherein said coupling member is adapted to close the front ends of said pair of grooves.

7. A device for mounting a cooking apparatus on a wall as set forth in claim 3, wherein said pair of grooves have a depth larger than a height of the legs of said cooking apparatus.

8. A device for mounting a cooking apparatus on a wall as set forth in claim 1, wherein said stopper member is mounted on said wall fixing member so as to face the upper rear portion of said cooking apparatus when said cooking apparatus is supported by said support member.

9. A device for mounting a cooking apparatus on a wall as set forth in claim 1, wherein each of said reinforcing members is formed so as to project forward from the front surface of said wall fixing member to provide an appropriate gap between the rear surface of said cooking apparatus and the front surface of said wall fixing member.

* * * * *